US011215948B2

(12) United States Patent
Tamaki et al.

(10) Patent No.: US 11,215,948 B2
(45) Date of Patent: Jan. 4, 2022

(54) POWDER COLLECTION DEVICE AND IMAGE FORMING APPARATUS INCORPORATING SAME

(71) Applicant: Ricoh Company, Ltd., Tokyo (JP)

(72) Inventors: Shuntaroh Tamaki, Kanagawa (JP); Junichi Matsumoto, Kanagawa (JP); Tatsuya Kubo, Kanagawa (JP); Hiroaki Okamoto, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/932,888

(22) Filed: Jul. 20, 2020

(65) Prior Publication Data

US 2021/0034007 A1 Feb. 4, 2021

(30) Foreign Application Priority Data

Jul. 31, 2019 (JP) ..... JP2019-140654

(51) Int. Cl.
*G03G 21/12* (2006.01)
*G03G 15/00* (2006.01)
*G03G 21/10* (2006.01)

(52) U.S. Cl.
CPC ..... *G03G 21/12* (2013.01); *G03G 15/50* (2013.01); *G03G 21/105* (2013.01)

(58) Field of Classification Search
CPC ..... G03G 21/10; G03G 21/105; G03G 21/12
See application file for complete search history.

(56) References Cited

U.S. PATENT DOCUMENTS 3,793,986 A * 2/1974 Latone ..... G03G 21/105 399/359
4,099,167 A * 7/1978 Pomerantz ..... G01F 23/265 340/620
5,465,619 A * 11/1995 Sotack ..... G01F 23/265 118/694
5,682,184 A * 10/1997 Stephany ..... B41J 2/17566 347/7
6,431,670 B1 * 8/2002 Schantz ..... G01F 23/266 347/7
6,670,817 B2 * 12/2003 Fournier ..... G03G 15/0881 324/658
7,555,231 B2 * 6/2009 Etter ..... G03G 21/12 324/662
7,689,156 B2 * 3/2010 Shishikura ..... G03G 21/12 399/358
7,836,762 B2 * 11/2010 Gamberini ..... G01G 17/00 73/304 C (Continued)

FOREIGN PATENT DOCUMENTS

JP 06118844 A * 4/1994
JP 7-319351 12/1995

(Continued)

*Primary Examiner* — Walter L Lindsay, Jr.
*Assistant Examiner* — Milton Gonzalez
(74) *Attorney, Agent, or Firm* — Xsensus LLP

(57) ABSTRACT

A powder collection device includes a collection container configured to store powder collected and a powder amount detector including a pair of electrodes. The powder amount detector detects an amount of powder in the collection container based on capacitance between the pair of electrodes.

13 Claims, 12 Drawing Sheets

(56) References Cited

U.S. PATENT DOCUMENTS

| | | | | |
|---|---|---|---|---|
| 7,929,899 | B2 * | 4/2011 | Fukunaga | G03G 21/12 399/360 |
| 9,395,646 | B2 * | 7/2016 | Tarui | G03G 21/10 |
| 2017/0363987 | A1 | 12/2017 | Nodera et al. | |
| 2018/0004124 | A1 * | 1/2018 | Shibukawa | G03G 15/0865 |
| 2019/0064699 | A1 | 2/2019 | Nodera et al. | |
| 2020/0033751 | A1 | 1/2020 | Matsumoto et al. | |

FOREIGN PATENT DOCUMENTS

| | | | | |
|---|---|---|---|---|
| JP | 2001121681 | A | * | 5/2001 |
| JP | 2001-175047 | | | 6/2001 |
| JP | 2004101592 | A | * | 4/2004 |
| JP | 2008203811 | A | * | 9/2008 |
| JP | 2013-120320 | | | 6/2013 |
| JP | 2018-060076 | | | 4/2018 |
| JP | 2018066789 | A | * | 4/2018 |
| JP | 2018-072477 | | | 5/2018 |

* cited by examiner

POWDER COLLECTION DEVICE AND IMAGE FORMING APPARATUS INCORPORATING SAME

CROSS-REFERENCE TO RELATED APPLICATION

This patent application is based on and claims priority pursuant to 35 U.S.C. § 119(a) to Japanese Patent Application No. 2019-140654, filed on Jul. 31, 2019, in the Japan Patent Office, the entire disclosure of which is hereby incorporated by reference herein.

BACKGROUND

Technical Field

Embodiments of the present disclosure generally relate to a powder collection device and an image forming apparatus incorporating the powder collection device.

Description of the Related Art

There is known a powder collection device that includes a collection container to store powder collected from outside and a powder amount detector to detect an amount of powder in the collection container.

SUMMARY

Embodiments of the present disclosure describe an improved powder collection device that includes a collection container configured to store powder collected and a powder amount detector including a pair of electrodes. The powder amount detector detects an amount of powder in the collection container based on capacitance between the pair of electrodes.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein:

FIGS. 16A-1, 16A-2, 16B-1, and 16B-2 are schematic cross-sectional views illustrating lines of electric force in the case in which the flat plate electrodes in parallel are disposed below and above the waste toner bottle in the vertical direction and in the case in which the flat plate electrodes in parallel are disposed on the left and right sides of the waste toner bottle in the horizontal direction;

Figure 1:
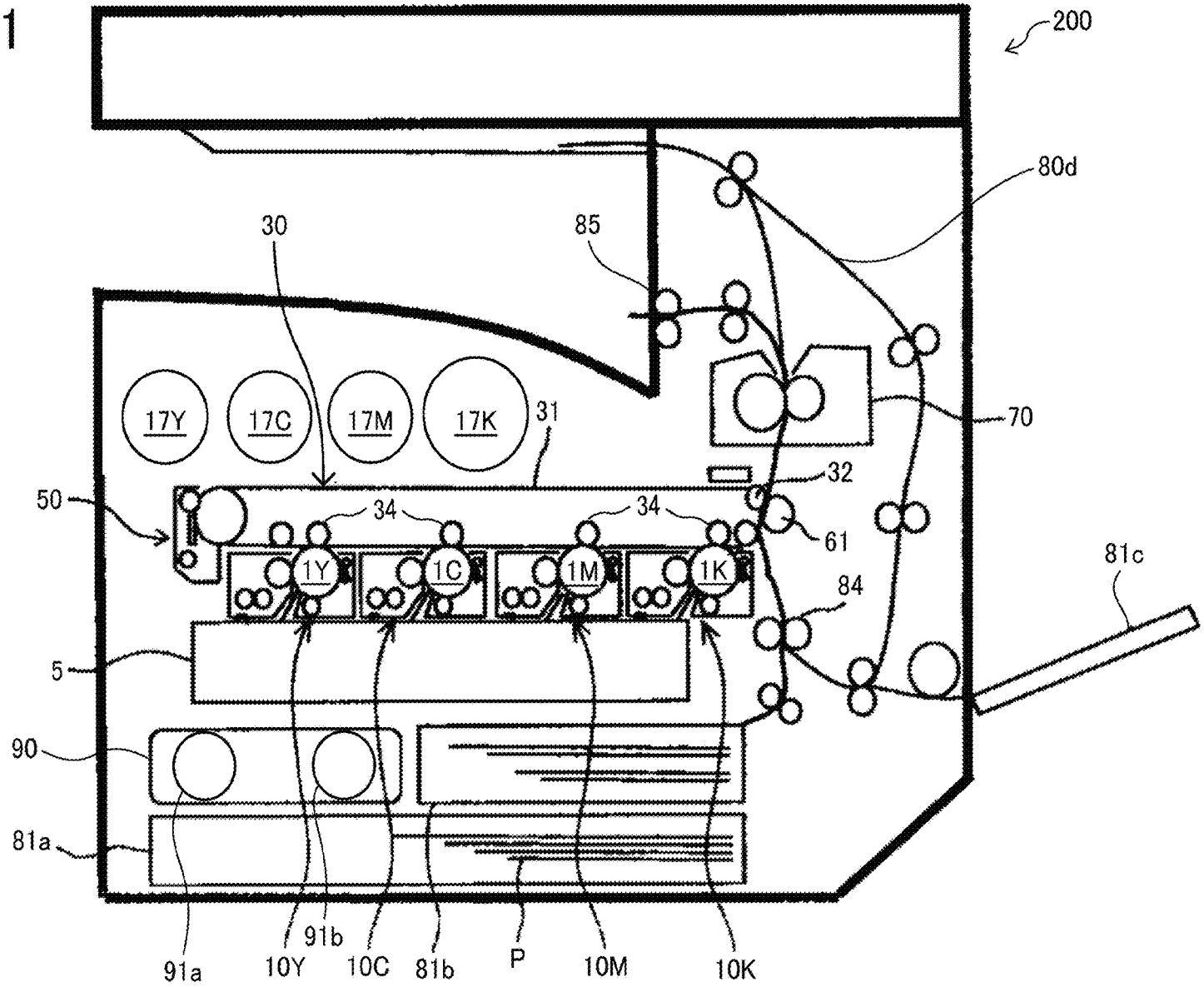
FIG. 1 is a schematic view illustrating a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views.

DETAILED DESCRIPTION

Descriptions are given below of an electrophotographic image forming apparatus according to an embodiment of the present invention.

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

As used herein, the singular forms "a", "an", and "the" are intended to include the plural forms as well, unless the context clearly indicates otherwise.

It is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

FIG. 1 is a schematic view illustrating a configuration of an image forming apparatus 200 according to the present embodiment.

The image forming apparatus 200 includes four image forming units 10Y, 10C, 10M, and 10K (also collectively referred to as the "mage forming units 10") for forming yellow (Y), cyan (C), magenta (M), and black (K) toner images. The four image forming units 10Y, 10C, 10M and 10K are arranged side by side in the order of yellow, cyan, magenta, and black (Y, C, M, and K) from the left to the right in FIG. 1. Alternatively, the four image forming units 10Y, IOC, 10M and 10K may be arranged side by side in another order.

The image forming units 10Y, 10C, 10M and 10K include photoconductor drums 1Y, 1C, 1M and 1K, respectively, around each of which a charging roller as a charging device, a developing device, and a cleaning device are disposed. The image forming unit 10 is a process cartridge that accommodates the photoconductor drum 1 and the surrounding components such as the charging roller, the developing device, and the cleaning device in a common support as a single unit. Accordingly, the image forming unit 10 is removably installable in the image forming apparatus 200, and therefore, expendables thereof are replaceable at once when depleted.

Below the image forming units 10Y, 10M, 10C, and 10K, an optical writing device 5 is disposed. The optical writing device 5 includes a light source, a polygon mirror, an f-θ lens, and a reflection mirror and irradiates the surfaces of the photoconductor drums 1Y, 1C, 1M, and 1K with laser beams according to image data to form electrostatic latent images of yellow, cyan, magenta, and black on the photoconductor drums 1Y, 1C, 1M, and 1K, respectively.

Above the image forming units 10Y, 10C, 10M, and 10K, an intermediate transfer unit 30 including an intermediate transfer belt 31 is disposed. The intermediate transfer unit 30 transfers toner images from the photoconductor drums 1Y, 1C, 1M, and 1K to a sheet P via the intermediate transfer belt 31. The intermediate transfer belt 31 is an endless belt stretched around a plurality of rollers and is rotated counterclockwise in FIG. 1 as at least one of the plurality of rollers rotates. In addition to the intermediate transfer belt 31, the intermediate transfer unit 30 includes primary transfer rollers 34, a belt cleaning device 50 including a brush roller and a cleaning blade.

The primary transfer rollers 34 and the photoconductor drums 1Y, 1C, 1M, and 1K nip the intermediate transfer belt 31. Accordingly, the photoconductor drums 1Y, 1C, 1M, and 1K contact the front face of the intermediate transfer belt 31, and the contact portions therebetween serve as primary transfer nips for yellow, cyan, magenta, and black, respectively. The intermediate transfer unit 30 further includes a secondary transfer backup roller 32 and a secondary transfer roller 61. The secondary transfer roller 61 is disposed outside the loop of the intermediate transfer belt 31 and opposed to the secondary transfer backup roller 32 at a position downstream from the image forming unit 10K for black in a direction in which the intermediate transfer belt 31 rotates. The secondary transfer roller 61 and the secondary transfer backup roller 32 nip the intermediate transfer belt 31 to form a secondary transfer nip.

A fixing device 70 is disposed above the secondary transfer roller 61. The fixing device 70 includes a fixing roller and a pressure roller that rotate while contacting each other, thereby forming a fixing nip therebetween. The fixing roller incorporates a halogen heater to keep the surface of the fixing roller at a predetermined temperature with electric power supplied from a power source.

The image forming apparatus 200 includes sheet trays 81*a* and 81*b*, a sheet feeding roller, and a registration roller pair 84 in a bottom portion thereof. The sheet trays 81*a* and 81*b* accommodate a stack of sheets P, each serving as a recording medium to record an output image. A bypass sheet feeding tray 81*c* is disposed on an external side of the image forming apparatus 200 to feed the sheet P.

In an upper portion of the image forming apparatus 200, toner bottles 17Y, 17C, 17M, and 17K as storage containers are disposed to supply toner to the respective developing devices of the image forming units 10Y, 10C, 10M, and 10K. The image forming apparatus 200 further includes waste toner bottles 91*a* and 91*b* as collection containers and a power supply unit.

A description is given below of operations of the image forming apparatus 200. The charging roller uniformly charges the surface of the photoconductor drum 1 at a position where the charging roller contacts the photoconductor drum 1. After the surface of the photoconductor drum 1 is charged to a predetermined potential, the optical writing device 5 scans the surface of the photoconductor drum 1 with the laser beam according to image data to write an electrostatic latent image on the photoconductor drum 1. As the photoconductor drum 1 rotates, the surface of the photoconductor drum 1 bearing the electrostatic latent image reaches a position opposite the developing device, where the developing device deposits toner on the electrostatic latent image on the surface of the photoconductor drum 1. As a result, a toner image is formed on the surface of the photoconductor drum 1. A toner supply device supplies suitable amount of toner from the toner bottle 17 to the developing device according to an output of a toner concentration sensor.

The above operation is performed in the image forming units 10Y, 10C, 10M, and 10K at predetermined timings. As a result, yellow, cyan, magenta, and black toner images are formed on the surfaces of the photoconductor drums 1Y, 1C, 1M, and 1K, respectively. The yellow, cyan, magenta, and black toner images are primarily transferred in the respective primary transfer nips of the photoconductor drums 1Y, 1C, 1M, and 1K and sequentially superimposed on the front face of the intermediate transfer belt 31. Specifically, the toner images are transferred as a certain voltage opposite in polarity to toner is applied to the primary transfer rollers 34 by a primary transfer power source. Thus, a multicolor toner image is formed on the intermediate transfer belt 31.

The transfer residual toner on the photoconductor drum 1, which is not transferred at the primary transfer nip, is removed by the cleaning device. The removed transfer residual toner is conveyed to a waste toner conveyance unit by a conveying screw of the cleaning device as waste toner. The waste toner conveyed to the waste toner conveyance unit is collected in the waste toner bottles 91*a* and 91*b* accommodated in a waste toner bottle mount 90. The waste toner bottle mount 90 is disposed on the left side of the upper sheet tray 81*b* in FIGS. 1 and 2, which is the side opposite the direction to feed the sheet P.

The sheet P is fed from one of the sheet trays 81*a* and 81*b* or the bypass sheet feeding tray 81*c* toward the registration roller pair 84, which temporarily stops the sheet P. Then, the registration roller pair 84 rotates at a predetermined timing to forward the sheet P to the secondary transfer nip.

The multicolor toner image, which is constructed of the yellow, cyan, magenta, and black toner images superimposed on the intermediate transfer belt 31, is secondarily transferred to the sheet P in the secondary transfer nip where the secondary transfer roller 61 contacts the intermediate transfer belt 31. Specifically, the multicolor toner image is transferred as a certain voltage opposite in polarity to toner is applied to the secondary transfer roller 61 by a secondary transfer power source. The sheet P ejected from the secondary transfer nip is conveyed to the fixing device 70, which nips the sheet P in the fixing nip. In the fixing nip, the multicolor toner image is heated by the fixing roller and fixed on the sheet P. In the case of single sided printing, the sheet P carrying the multicolor toner image is then ejected to the exterior of the image forming apparatus 200 by an output roller pair 85. In the case of duplex printing, the sheet P is then conveyed to a duplex conveyance path 80*d* by conveyance rollers and flipped. Then, similarly to the above-described operation, another multicolor toner image is formed on a side of the sheet P opposite the side on which the multicolor toner image is previously formed. After the multicolor toner images are formed on both sides of the sheet P, the sheet P is ejected to the exterior of the image forming apparatus 200.

The transfer residual toner remaining on the intermediate transfer belt 31 after the secondary transfer process is removed by the belt cleaning device 50 disposed downstream from the secondary transfer backup roller 32 in the direction of rotation of the intermediate transfer belt 31, and the intermediate transfer belt 31 is prepared for subsequent toner image transfer. A collection screw of the belt cleaning device 50 conveys the transfer residual toner removed by the belt cleaning device 50 to the waste toner conveyance unit as waste toner. The waste toner conveyed to the waste toner conveyance unit is further conveyed to the waste toner bottles 91*a* and 91*b* and collected in the waste toner bottles 91*a* and 91*b*.

Figure 2:
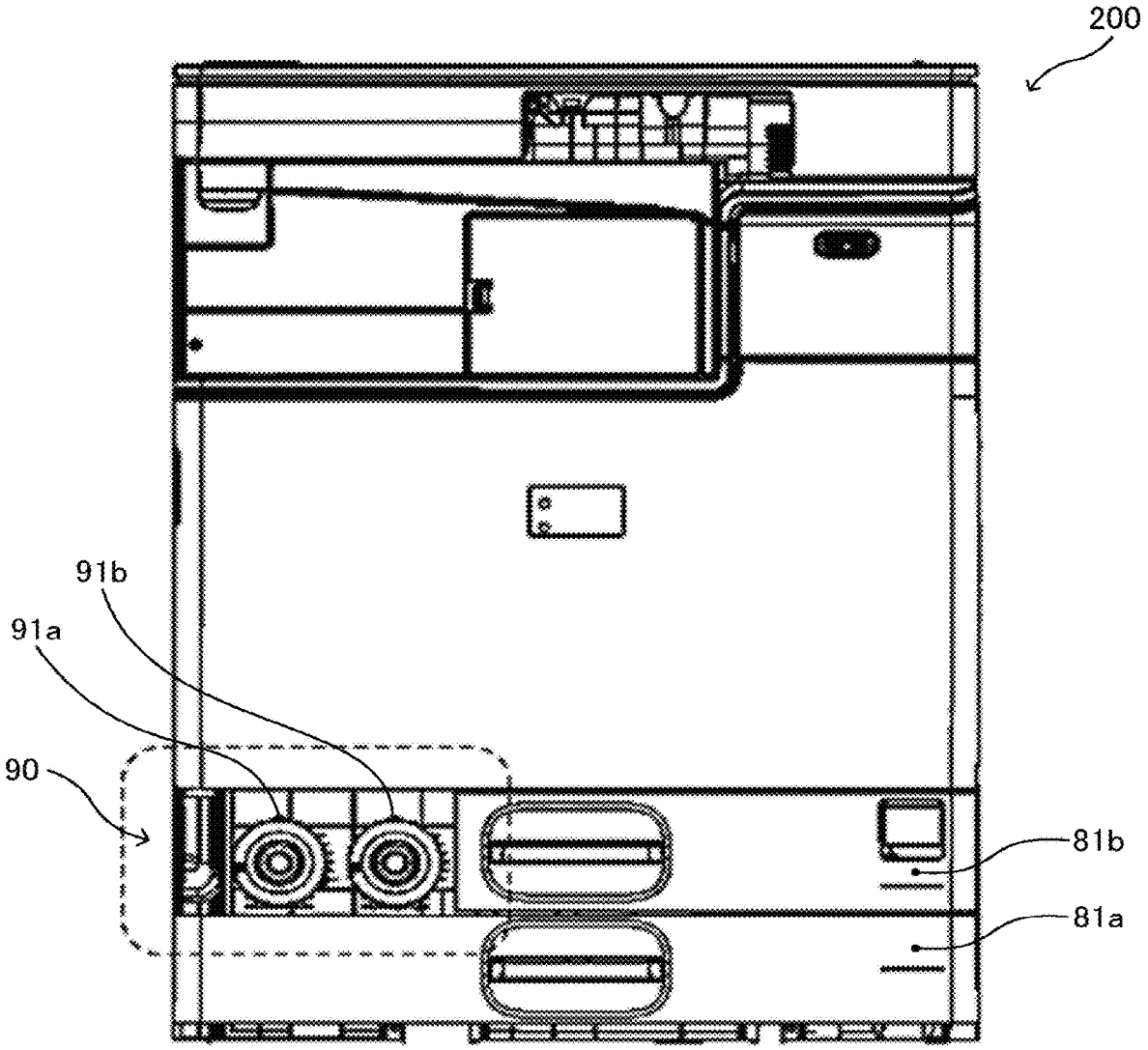
FIG. 2 is a front view of the image forming apparatus according to an embodiment of the present disclosure.

FIG. 2 is a front view of the image forming apparatus 200.

As illustrated in FIG. 2, the two waste toner bottles 91*a* and 91*b* are accommodated in the waste toner bottle mount 90 of a waste toner collection device 100 (see FIG. 3) and are detachably attachable via the front side of the image forming apparatus 200. The two waste toner bottles 91*a* and 91*b* have the same shape and are referred to as the "waste toner bottle 91" unless particularly distinguished. When the waste toner bottle 91 is filled with waste toner, the full waste toner bottle 91 is replaced with an empty waste toner bottle 91 from the front side of the image forming apparatus 200. Hereinafter, the waste toner bottle on the left side in FIGS. 1 and 2 is also referred to as the first waste toner bottle 91*a*, and the waste toner bottle on the right side in FIGS. 1 and 2 is also referred to as the second waste toner bottle 91*b* as required In the present embodiment, the toner bottle 17 and the waste toner bottle 91 have the same shape, and therefore, the empty toner bottle 17 is reusable as the waste toner bottle 91 when toner in the toner bottle 17 is depleted.

Figure 3:
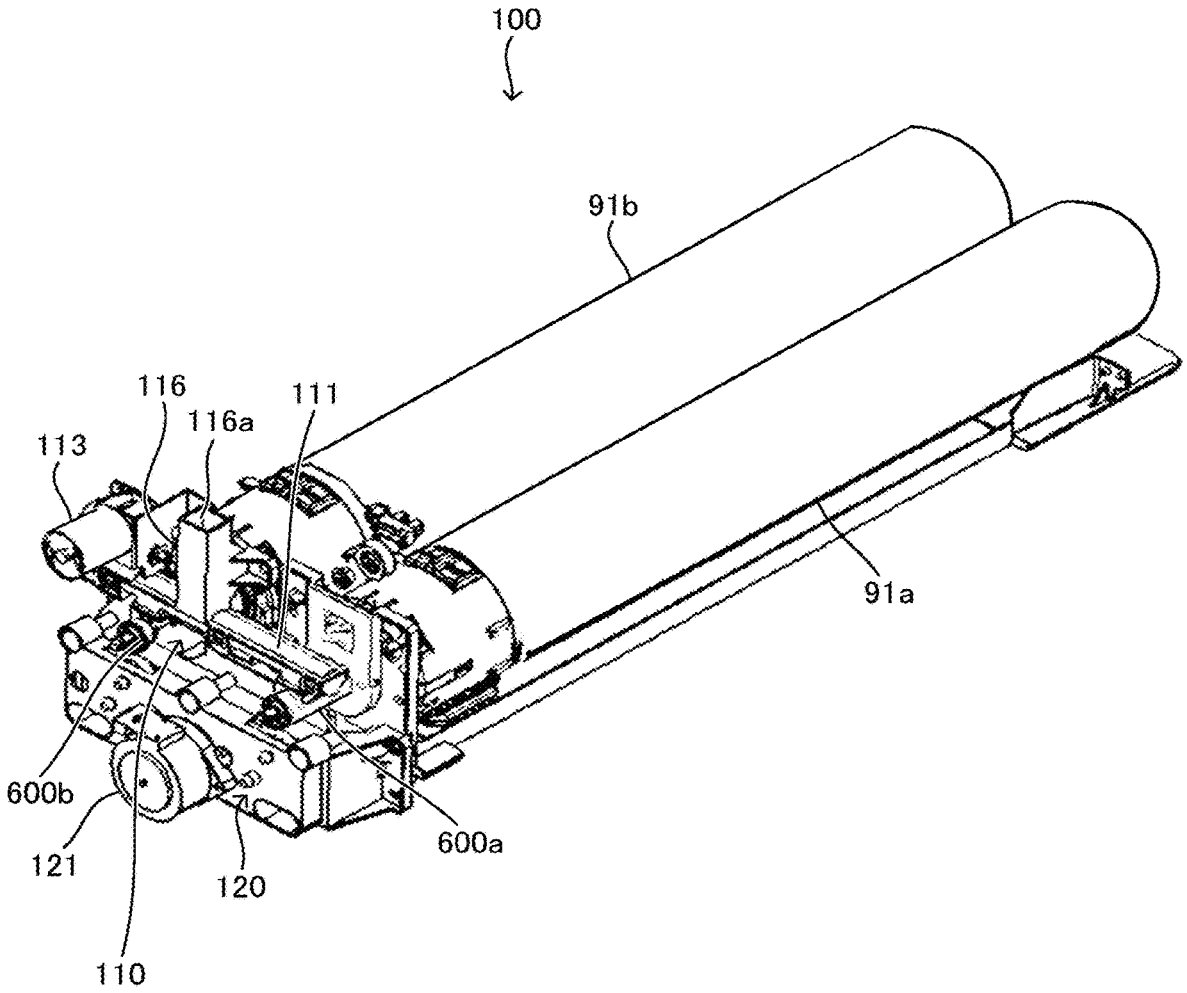
FIG. 3 is a schematic perspective view of a waste toner collection device according to an embodiment of the present disclosure.

FIG. 3 is a perspective view of the waste toner collection device 100 according to the present embodiment.

The waste toner collection device 100 as a powder collection device includes the two waste toner bottles 91*a* and 91*b* and a switching unit 110 to switch a destination of waste toner conveyed from the waste toner conveyance unit. The waste toner collection device 100 further includes a powder amount detector described later. The waste toner collection device 100 also includes a first waste toner carry-in section 600*a* as a conveyor to convey the waste toner into the first waste toner bottle 91*a*, and a second waste toner carry-in section 600*b* as a conveyor to convey the waste toner into the second waste toner bottle 91*b*. The waste toner collection device 100 further includes a bottle drive section 120 as a rotation driver to rotate a conveying screw 614 (see FIG. 6) of the first waste toner carry-in section 600*a*, the first waste toner bottle 91*a*, a conveying screw 614 of the second waste toner carry-in section 600*b*, and the second waste toner bottle 91*b*.

The first waste toner carry-in section 600*a* and the second waste toner carry-in section 600*b* have the same configuration and therefore, are referred to as the "waste toner carry-in section 600" unless particularly distinguished. Further, the waste toner carry-in section 600 has substantially the same configuration as the toner supply device, and the direction of rotation of the conveying screw 614 (see FIG. 6) is different from that of the toner supply device, thereby conveying the waste toner toward the waste toner bottle 91.

Figure 4:
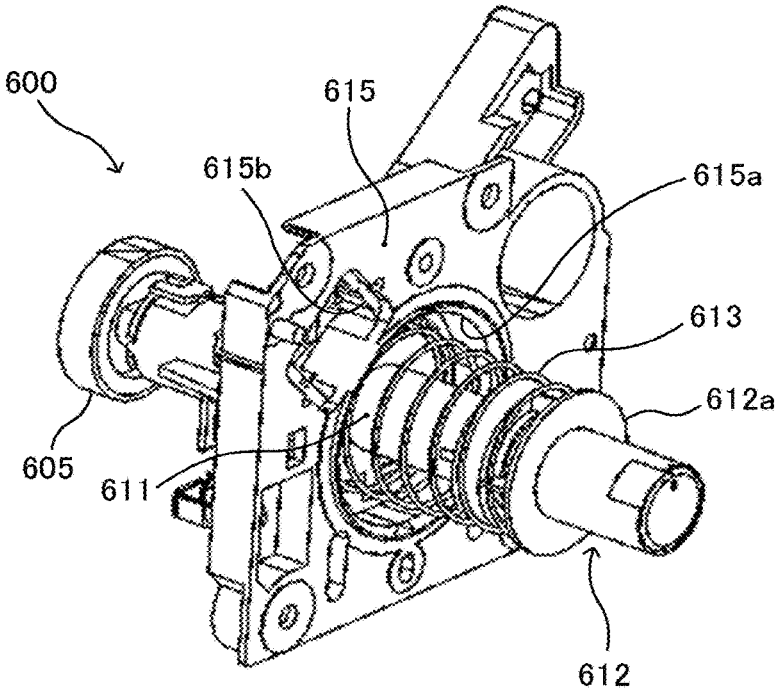
FIG. 4 is a perspective view of a waste toner carry-in section of the waste toner collection device.
Figure 5:
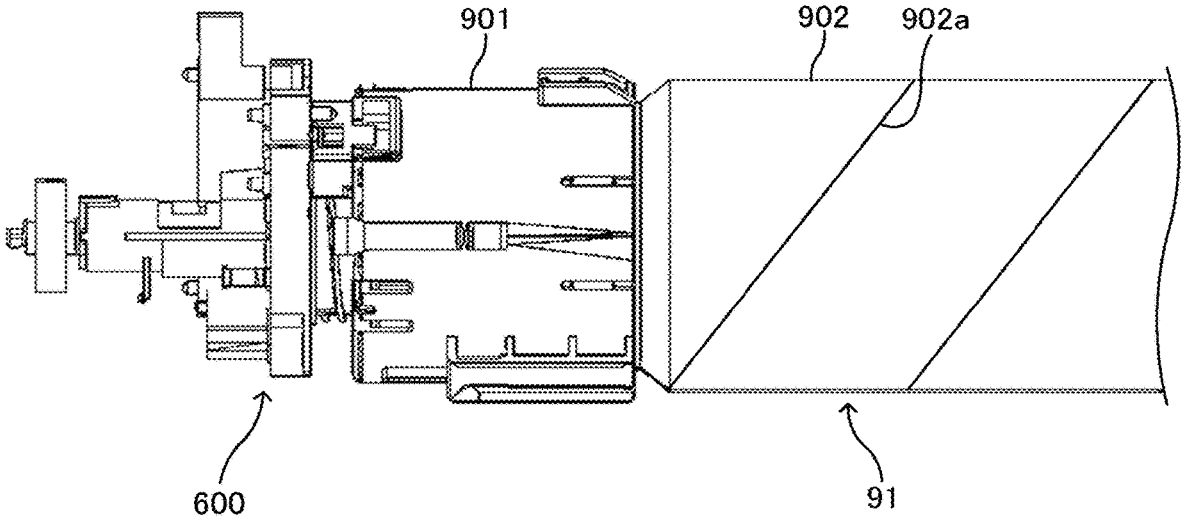
FIG. 5 is a schematic view illustrating a waste toner bottle attached to the waste toner carry-in section.
Figure 6:
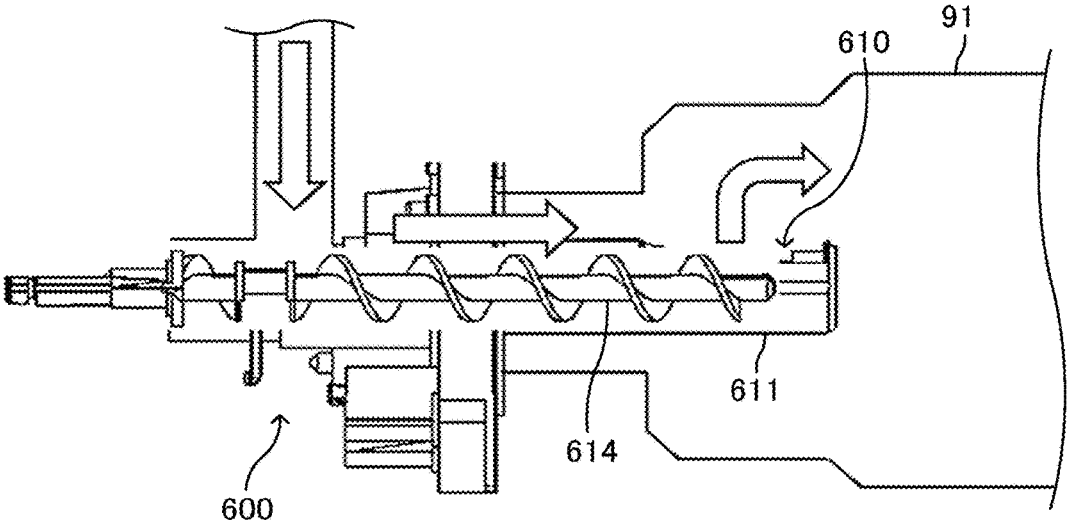
FIG. 6 is a schematic cross-sectional view illustrating the waste toner bottle attached to the waste toner carry-in section.

FIG. 4 is a perspective view of the waste toner carry-in section 600. FIG. 5 is a schematic view illustrating the waste toner bottle 91 attached to the waste toner carry-in section 600. FIG. 6 is a schematic cross-sectional view illustrating the waste toner bottle 91 attached to the waste toner carry-in section 600.

The waste toner bottle 91 is a substantially cylindrical bottle having the same shape as the toner bottle 17, and mainly includes a bottle end cover 901 and a bottle body 902. The bottle body 902 is integrated with a bottle gear and held rotatable relative to the bottle end cover 901. On the inner circumference of the bottle body 902, a helical rib 902*a* is disposed. In a state in which the bottle end cover 901 is attached to the waste toner carry-in section 600, rotation driving force is transmitted from the bottle drive section 120 to the bottle gear of the bottle body 902. With this driving force, the bottle body 902 is driven to rotate. The helical rib 902*a* projects inward from the inner circumference of the bottle body 902. As the bottle body 902 rotates, the helical rib 902*a* conveys the waste toner collected in the bottle body 902 from the front end to the rear end of the bottle body 902 (from the left to the right in FIG. 5) in the longitudinal direction of the bottle body 902.

The waste toner carry-in section 600 includes a conveyance nozzle 611 including the conveying screw 614 therein. A conveying screw gear 605 is disposed at the upstream end of the conveying screw 614 in the direction in which waste toner is conveyed. A nozzle opening 610 is disposed at the downstream end of the conveyance nozzle 611 in the direction in which waste toner is conveyed. Further, the waste toner carry-in section 600 includes a nozzle shutter 612 that closes the nozzle opening 610 when the waste toner bottle 91 is not attached (i.e., the state in FIG. 4).

As the bottle drive section 120 transmits the rotation driving force to the conveying screw gear 605, the conveying screw 614 rotates, thus conveying waste toner carried into the conveyance nozzle 611 as indicated by arrows in FIG. 6. Then, the waste toner is collected in the waste toner bottle 91 through the nozzle opening 610 disposed at the downstream end of the conveyance nozzle 611 in the direction in which waste toner is conveyed.

In the present embodiment, the nozzle opening 610 is disposed on the upper face of the conveyance nozzle 611, and the waste toner is collected in the waste toner bottle 91 so as to get over the nozzle opening 610. This configuration, in which the nozzle opening 610 is disposed on the upper face of the conveyance nozzle 611, can delay the time when the nozzle opening 610 is blocked by the waste toner in the waste toner bottle 91 as compared with the case in which the nozzle opening is disposed on the lower face of the conveyance nozzle 611. Accordingly, the waste toner bottle 91 can collect a large amount of waste toner therein.

Further, the waste toner carry-in section 600 includes a nozzle shutter spring 613 to bias a flange 612*a* disposed at the upstream end of the nozzle shutter 612 toward the downstream side in the direction in which waste toner is conveyed. When the waste toner bottle 91 is not attached, the nozzle shutter spring 613 positions the nozzle shutter 612 so as to close the nozzle opening 610.

The waste toner carry-in section 600 includes a bottle attachment section 615. The bottle attachment section 615 has a hole 615*a* into which the front end of the bottle end cover 901 is inserted. Further, the bottle attachment section 615 has an engagement hole 615*b*, and the bottle end cover 901 includes an engagement projection 901*a* (see FIG. 7) that engages the engagement hole 615*b*.

Figure 7:
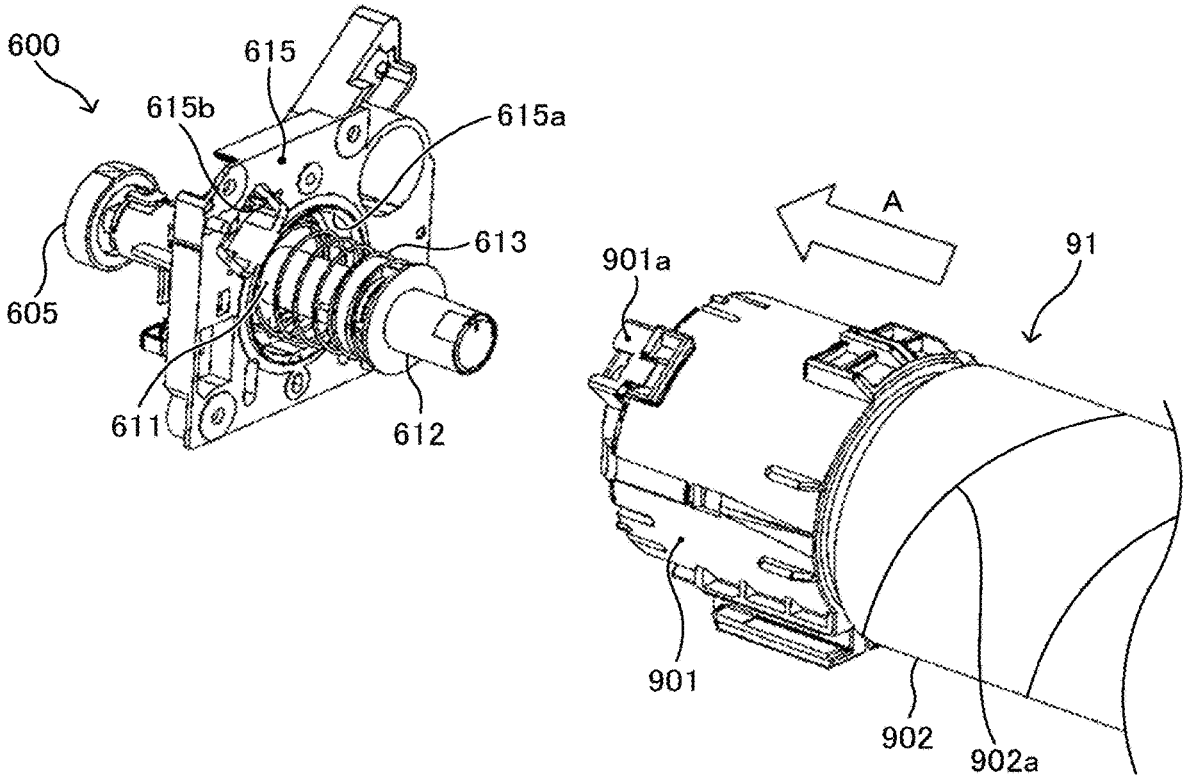
FIG. 7 is a perspective view illustrating how the waste toner bottle is attached to the waste toner carry-in section.

FIG. 7 is a perspective view illustrating how the waste toner bottle 91 is attached to the waste toner carry-in section 600.

As the waste toner bottle 91 is moved in the direction indicated by arrow A in FIG. 7, the front end of the conveyance nozzle 611 with the nozzle opening 610 closed by the nozzle shutter 612 is inserted into the waste toner bottle 91. As the conveyance nozzle 611 is inserted into the waste toner bottle 91, the flange 612*a* of the nozzle shutter 612 contacts a component inside the waste toner bottle 91. In this state, as the waste toner bottle 91 is further moved toward the waste toner carry-in section 600, the nozzle shutter 612 is moved together with the waste toner bottle 91 toward the conveying screw gear 605 of the waste toner carry-in section 600 relative to the conveyance nozzle 611 against the biasing force of the nozzle shutter spring 613, thereby opening the nozzle opening 610. Then, the front end of the bottle end cover 901 of the waste toner bottle 91 fits into the hole 615*a*, and the engagement projection 901*a* of the bottle end cover 901 enters the engagement hole 615*b*. Thus, the waste toner bottle 91 is attached to the waste toner carry-in section 600. Since the engagement projection 901*a* of the bottle end cover 901 engages the engagement hole 615*b*, the bottle end cover 901 is non-rotatably attached to the waste toner carry-in section 600.

Figure 8:
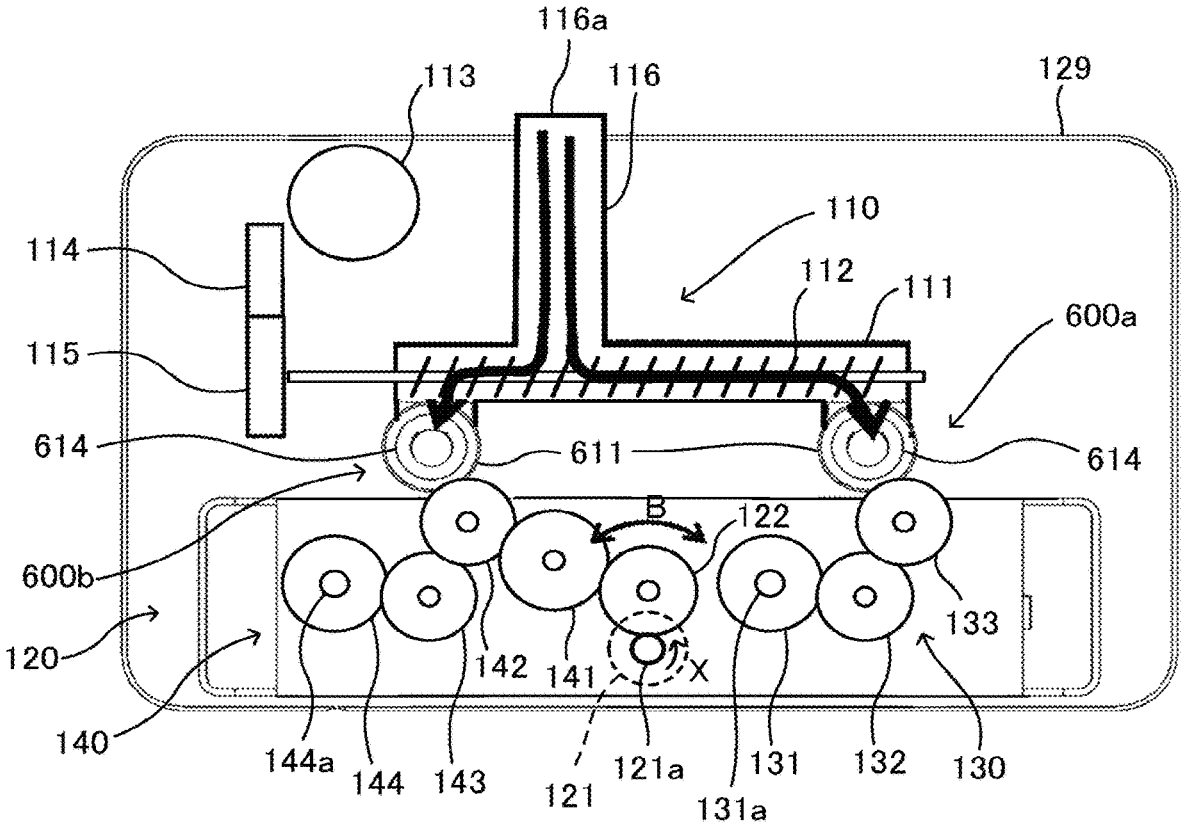
FIG. 8 is a schematic view of a switching unit and a bottle drive section of the waste toner collection device.

FIG. 8 is a schematic view of the switching unit 110 and the bottle drive section 120.

The switching unit 110 has a switching conveyance path 111 extending in the direction in which the waste toner bottles 91*a* and 91*b* are arranged (i.e., the horizontal direction in FIG. 8). One end (right end in FIG. 8) of the switching conveyance path 111 is coupled to the conveyance nozzle 611 of the first waste toner carry-in section 600*a*, and the other end (left end in FIG. 8) of the switching conveyance path 111 is coupled to the conveyance nozzle 611 of the second waste toner carry-in section 600*b*. A switching screw 112 is disposed in the switching conveyance path 111.

The switching unit 110 includes a waste toner inlet 116*a* disposed at the top of the switching unit 110 and a waste toner downward path 116. Waste toner enters the waste toner inlet 116*a* and falls in the waste toner downward path 116 toward the switching conveyance path 111. The waste toner downward path 116 is coupled to a portion between the one end and the other end of the switching conveyance path 111. A switching screw gear 115 is attached to the left end of the shaft of the switching screw 112 in FIG. 8. Driving force of a switching motor 113 is transmitted to the switching screw gear 115 via a skew gear such as a worm gear, and a driven gear 114.

When the switching motor 113 rotates in one direction, the switching screw 112 conveys waste toner, which has fallen from the waste toner downward path 116 to the switching conveyance path 111, to the right in FIG. 8 and supplies the waste toner to the conveyance nozzle 611 of the first waste toner carry-in section 600*a*. When the switching motor 113 rotates in the other direction opposite the one direction, the switching screw 112 conveys waste toner, which has fallen from the waste toner downward path 116 to the switching conveyance path 111, to the left in FIG. 8 and supplies the waste toner to the conveyance nozzle 611 of the second waste toner carry-in section 600*b*.

Accordingly, the destination of waste toner conveyed from the waste toner conveyance unit is switchable between the two waste toner bottles 91*a* and 91*b*. The destination may be switched so that the waste toner is evenly stored in the two waste toner bottles 91*a* and 91*b*. Alternatively, the waste toner is conveyed to one of the two waste toner bottles 91*a* and 91*b*, and then, the destination may be switched to the other of the two waste toner bottle 91*a* and 91*b* after the one of the two waste toner bottles 91*a* and 91*b* becomes full.

In the former operation in which the destination is switched so that the waste toner is evenly stored in the two waste toner bottles 91*a* and 91*b*, some users may be not required to replace the waste toner bottles 91*a* and 91*b* even once. In the latter operation in which the waste toner is conveyed to one of the waste toner bottles 91*a* and 91*b* until the one of the waste toner bottles 91*a* and 91*b* becomes full, when the one of the waste toner bottles becomes full and the empty toner bottle 17 is not prepared, the waste toner can be collected in the other of the waste toner bottles 91*a* and 91*b*. As a result, after toner in the toner bottle 17 set in the image forming apparatus 200 is depleted and the empty toner bottle 17 is replaced with a new toner bottle 17, the replaced empty toner bottle 17 is reusable as a new waste toner bottle 91 to be replaced with the full waste toner bottle 91. Therefore, a stock of empty toner bottles 17 is unnecessary for replacing the full waste toner bottle 91, thereby improving user convenience.

The bottle drive section 120 is disposed below the switching unit 110, and mainly includes a drive motor 121 such as a stepping motor, a first transmission 130, a second transmission 140, and a swing gear 122. The swing gear 122 meshes with a motor gear 121*a* of the drive motor 121. The swing gear 122 is swingably supported by a side plate 129 of the waste toner collection device 100 and movable around the motor gear 121*a* within a predetermined range as indicated by arrow B in FIG. 8.

The first transmission 130 includes a first bottle drive gear 131, a first idler gear 132, and a first screw input gear 133. A gear that meshes with the bottle gear of the first waste toner bottle 91*a* is attached to a shaft 131*a* of the first bottle drive gear 131. The first idler gear 132 meshes with the first bottle drive gear 131 and the first screw input gear 133. The first screw input gear 133 also meshes with the conveying screw gear 605 attached to the conveying screw 614 of the first waste toner carry-in section 600*a*.

The second transmission 140 includes an input gear 141, a second screw input gear 142, a second idler gear 143, and a second bottle drive gear 144. The second screw input gear 142 meshes with the input gear 141, the conveying screw gear 605 attached to the conveying screw 614 of the second waste toner carry-in section 600*b*, and the second idler gear 143. The second bottle drive gear 144 meshes with the second idler gear 143. A gear that meshes with the bottle gear of the second waste toner bottle 91*b* is attached to a shaft 144*a* of the second bottle drive gear 144.

As the drive motor 121 is driven to rotate counterclockwise as indicated by arrow X in FIG. 8, force toward the left in FIG. 8 is applied from the motor gear 121*a* to the swing gear 122. Accordingly, the swing gear 122 moves to the left in FIG. 8 and meshes with the input gear 141 of the second transmission 140. As a result, driving force of the drive motor 121 is transmitted to the second transmission 140, and the bottle body 902 of the second waste toner bottle 91*b* and the conveying screw 614 of the second waste toner carry-in section 600*b* rotate. Thus, waste toner in the second waste toner bottle 91*b* is conveyed to the rear end of the second waste toner bottle 91*b* by the helical rib 902*a* of the bottle body 902, and waste toner supplied from the switching unit 110 is conveyed by the conveying screw 614 and carried into the second waste toner bottle 91*b*.

On the other hand, as the drive motor 121 is driven to rotate in the clockwise direction opposite the direction indicated by arrow X in FIG. 8, force toward the right in FIG. 8 is applied from the motor gear 121*a* to the swing gear 122. Accordingly, the swing gear 122 moves to the right in FIG. 8 and meshes with the first bottle drive gear 131 of the first transmission 130. As a result, the driving force of the drive motor 121 is transmitted to the first transmission 130, and the bottle body 902 of the first waste toner bottle 91*a* and the conveying screw 614 of the first waste toner carry-in section 600*a* rotate. Thus, waste toner in the first waste toner bottle 91*a* is conveyed to the rear end of the first waste toner bottle 91*a* by the helical rib 902*a* of the bottle body 902, and waste toner supplied from the switching unit 110 is conveyed by the conveying screw 614 and carried into the first waste toner bottle 91*a*.

In the present embodiment, the waste toner carry-in section 600 is provided with the conveyance nozzle 611. A portion of the downstream side of the conveyance nozzle 611 in the direction in which waste toner is conveyed is inserted into the waste toner bottle 91, and the conveying screw 614 conveys waste toner into the waste toner bottle 91. Therefore, waste toner can be reliably collected in the waste toner bottle 91. Further, the conveying screw 614 conveys waste toner into the waste toner bottle 91, thereby improving the stability to convey waste toner as compared with the case in which waste toner is conveyed to the waste toner bottle 91 under gravity.

Figure 9A:
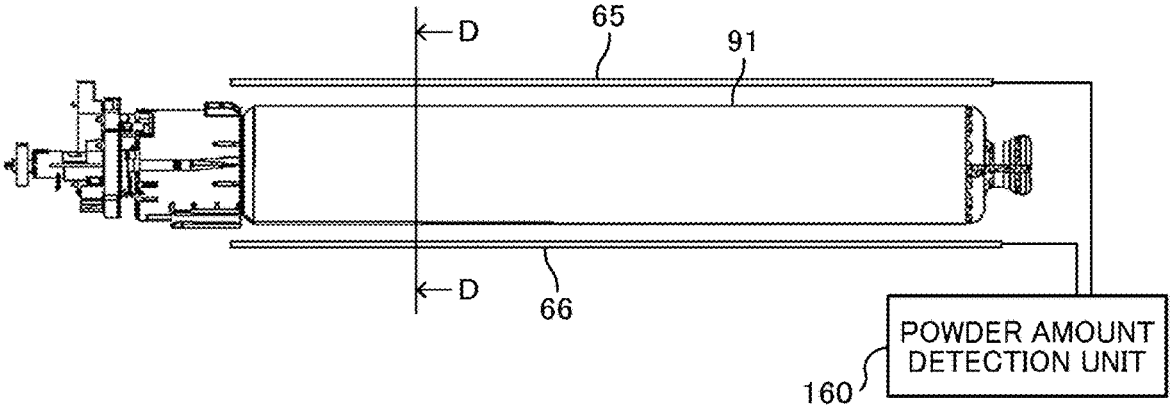
FIGS. 9A and 9B are schematic views illustrating how to detect an amount of waste toner according to an embodiment of the present disclosure.
Figure 9B:
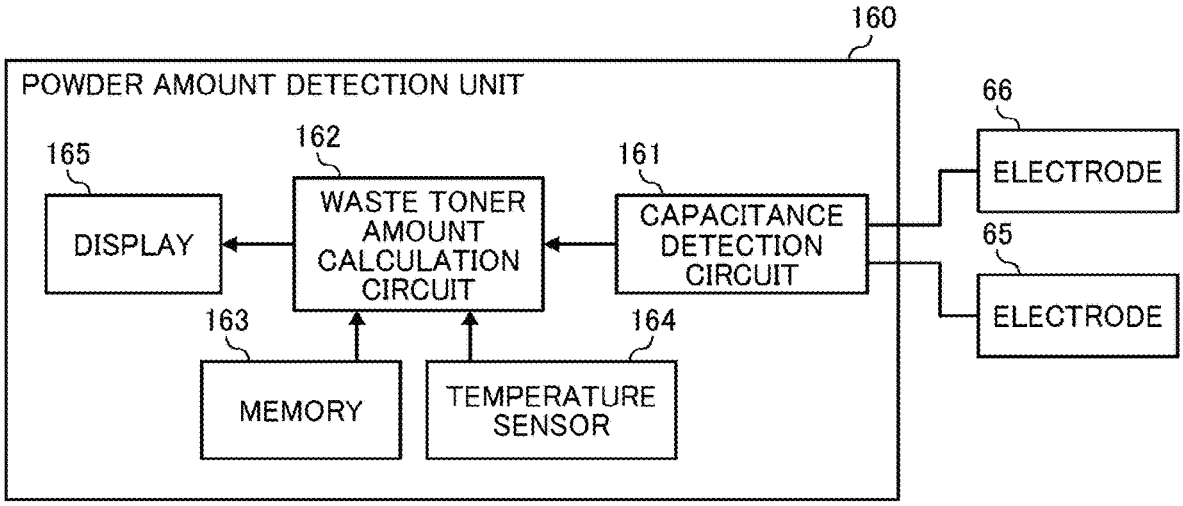
Figure 10:
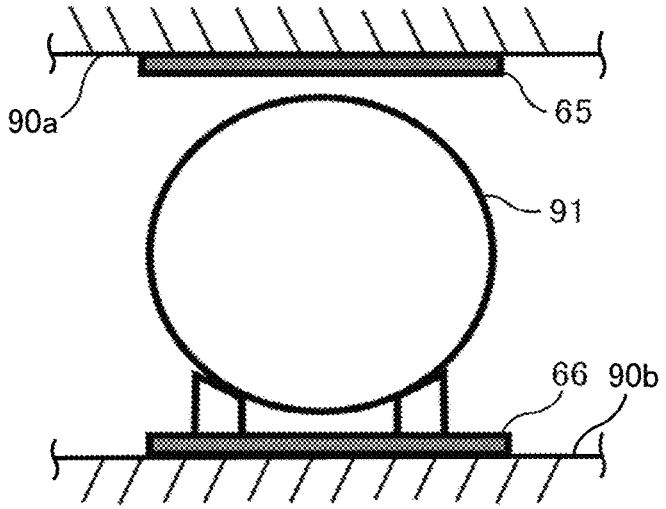
FIG. 10 is a cross-sectional view along line D-D in FIG. 9.

Next, detection of an amount of waste toner in the waste toner bottle 91 is described. FIGS. 9A and 9B are schematic views illustrating how to detect the amount of waste toner according to the present embodiment. FIG. 10 is a cross-sectional view along line D-D in FIG. 9.

In the present embodiment, a pair of flat plate electrodes 65 and 66 sandwiches the waste toner bottle 91 in parallel and covers almost the entire waste toner bottle 91. Specifically, a width of the flat plate electrodes 65 and 66 in the transverse direction (the horizontal direction in FIG. 10) is longer than a diameter of the waste toner bottle 91, and a length of the flat plate electrodes 65 and 66 in the longitudinal direction of the waste toner bottle 91 (the horizontal direction in FIG. 9A) is longer than or equal to a half length of the waste toner bottle 91.

The upper flat plate electrode 65 is secured to an upper wall 90*a* of the waste toner bottle mount 90, which is opposed to the upper side of the waste toner bottle 91, by double-sided tape. The lower flat plate electrode 66 is secured to a lower wall 90*b* of the waste toner bottle mount 90, which is opposed to the lower side of the waste toner bottle 91, by double-sided tape. The flat plate electrodes 65 and 66 arranged in parallel are made of any conductive material, for example, iron plate in the present embodiment.

The pair of flat plate electrodes 65 and 66 in parallel has the same size, thereby preventing a density of lines of electric force between the flat plate electrodes 65 and 66 from varying. Accordingly, when the amount of toner in the waste toner bottle 91 is the same, uneven distribution of toner in the waste toner bottle 91 does not cause capacitance to vary.

Each of the flat plate electrodes 65 and 66 is connected to a capacitance detection circuit 161 of a powder amount detection unit 160. The capacitance detection circuit 161 applies electric power to the pair of flat plate electrodes 65 and 66 in parallel, thereby detecting the capacitance between the pair of flat plate electrodes 65 and 66. A known method of detecting capacitance can be used. In the present embodiment, a charging method is used in which the capacitance is measured by a relation between the time of charge arrival point and the voltage or current while a constant voltage or a constant current is applied between the pair of flat plate electrodes 65 and 66.

The detection result obtained by the capacitance detection circuit 161 is transmitted to a waste toner amount calculation circuit 162, and the waste toner amount calculation circuit 162 calculates the amount of waste toner in the waste toner bottle 91 based on the measured capacitance. The measured capacitance varies depending on a dielectric constant between the flat plate electrodes 65 and 66 in parallel. Toner has a higher dielectric constant than air. Therefore, the dielectric constant varies according to the amount of waste toner in the electric field between the flat plate electrodes 65 and 66 in parallel. As a result, the capacitance varies depending on the amount of waste toner in the waste toner bottle 91 sandwiched by the pair of flat plate electrodes 65 and 66. Thus, the amount of waste toner in the waste toner bottle 91 can be calculated by detecting the capacitance.

In the present embodiment, the waste toner amount calculation circuit 162 calculates the amount of waste toner in the waste toner bottle 91 based on a calibration curve stored in a memory 163 and the capacitance obtained by the capacitance detection circuit 161. The calibration curve preliminarily acquired indicates the relation between the capacitance and the amount of waste toner in the waste toner bottle 91. As described above, in the present embodiment, a powder amount detector (a waste toner amount detector) includes the flat plate electrodes 65 and 66 in parallel and the powder amount detection unit 160 including the capacitance detection circuit 161, the waste toner amount calculation circuit 162, the memory 163, and a display 165.

In the present embodiment, the amount of waste toner in the waste toner bottle 91 can be detected based on the capacitance. With this configuration, the following advantages are obtained.

That is, the waste toner bottle 91 and the toner bottle 17 have the same shape, and therefore, the empty toner bottle 17 is reusable as the waste toner bottle 91. When toner in the toner bottle 17 is depleted, an operator replaces the toner bottle 17 with a new toner bottle 17. Subsequently, the operator can determine how to dispose of the replaced empty toner bottle 17 based on the amount of waste toner displayed on the display 165. For example, when the amount of waste toner is small, the toner bottle 17 may be discarded or collected by the manufacturer. On the other hand, when the waste toner bottle 91 is almost filled with waste toner, the replaced empty toner bottle 17 can be stocked as a waste toner bottle 91. In this case, alternatively, the operator can replace the waste toner bottle 91 with the replaced empty toner bottle 17 before the waste toner bottle 91 becomes full. Thus, by detecting the amount of waste toner in the waste toner bottle 91, the operator can appropriately dispose of the replaced empty toner bottle 17.

In a case in which a pair of electrodes is disposed inside a waste toner bottle to detect capacitance, waste toner may adhere to the pair of electrodes. Accordingly, it is difficult to accurately detect the amount of waste toner in the waste toner bottle. Further, the waste toner bottle is replaced when being full. Therefore, the waste toner bottle including the pair of electrodes therein increases the cost of the waste toner bottle, and the running cost of the image forming apparatus employing the waste toner bottle also increases. Further, the waste toner bottle thermally expands greatly because the waste toner bottle is made of resin. When the pair of electrodes is disposed in the waste toner bottle, the distance between the pair of electrodes varies due to the thermal expansion of the waste toner bottle. Accordingly, it is difficult to accurately detect the amount of waste toner in the waste toner bottle.

In the present embodiment, the flat plate electrodes 65 and 66 are disposed outboard of the waste toner bottle 91 in parallel, thereby preventing toner from adhering to the flat plate electrodes 65 and 66. Therefore, the amount of waste toner can be detected accurately. The number of components and the cost of the waste toner bottle 91 can be reduced. Under high temperature environment, the amount of waste toner can be accurately detected without being affected by the thermal expansion of the waste toner bottle 91.

With such a configuration in which the pair of flat plate electrodes 65 and 66 sandwiches the waste toner bottle 91 in parallel, the capacitance does not vary due to the shape error or rotational eccentricity of the waste toner bottle 91. Therefore, the amount of waste toner can be detected accurately.

In the present embodiment, the pair of flat plate electrodes 65 and 66 covers almost the entire waste toner bottle 91. With this configuration, almost all waste toner in the waste toner bottle 91 is included in the lines of electric force between the pair of flat plate electrodes 65 and 66 (i.e., electric field). Therefore, the amount of waste toner in the waste toner bottle 91 can be detected accurately even if the waste toner is unevenly distributed in the waste toner bottle 91, and the accurate amount of waste toner can be reported to a user.

Figure 11:
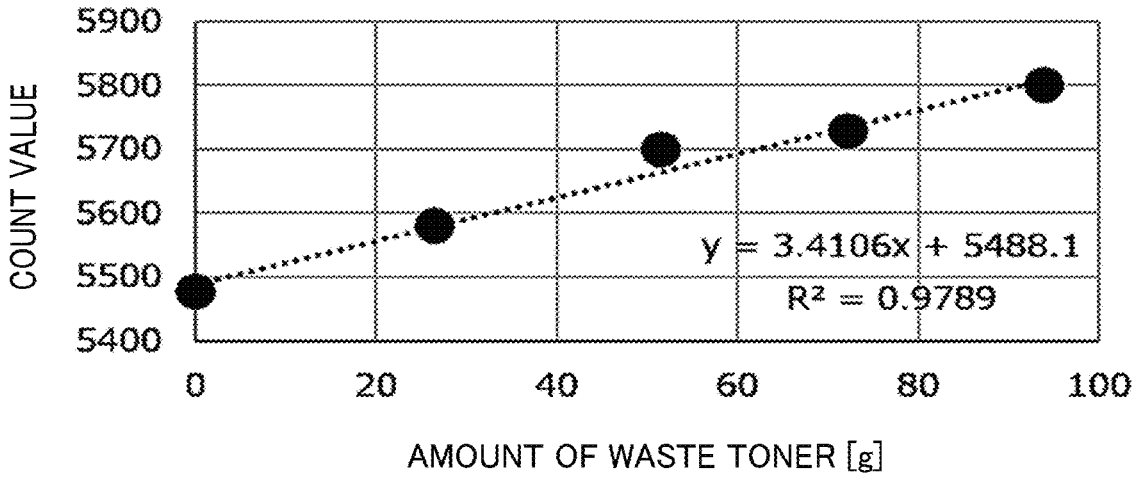
FIG. 11 is a graph illustrating an example of a calibration curve indicating a relation between the amount of waste toner in the waste toner bottle and capacitance.

FIG. 11 is a graph illustrating an example of the calibration curve indicating a relation between the amount of waste toner in the waste toner bottle 91 and the capacitance. As illustrated in FIG. 11, the relation between the amount of waste toner in the waste toner bottle 91 and the capacitance indicated by count value in FIG. 11 is approximately linear. Therefore, the amount of waste toner in the waste toner bottle 91 can be accurately calculated based on the capacitance.

The composition of the waste toner may change depending on whether a user prints a large number of monochrome images or a large number of color images, and the relation between the capacitance and the amount of waste toner may be different. Further, the composition of the waste toner may be different between the case in which paper that easily generates paper dust is used and the case in which paper that does not generate much paper dust is used. Therefore, multiple relations between the amount of waste toner having different composition and the capacitance are acquired, and the average of the obtained relations between the amount of waste toner and the capacitance can be used as the calibration curve. Alternatively, multiple relations between the amount of waste toner having different composition and the capacitance are acquired, and one of the multiple relations having the smallest gradient can be used as the calibration curve.

A distance between the flat plate electrodes 65 and 66 may be different for each device due to assembly tolerances, and the relation between the amount of waste toner and the capacitance may also be different. As described above, the composition of the waste toner may be different depending on the usage conditions of the image forming apparatus 200, and the relation between the capacitance and the amount of waste toner may also be different. Therefore, in the present embodiment, the powder amount detector can employ a calibration curve calculation mode to acquire a calibration curve. At a predetermined timing, such as before factory shipment or when the waste toner bottle 91 is filled with waste toner, the calibration curve calculation can be performed. Thus, the calibration curve can be acquired and stored in the memory 163. The calibration curve calculation can be performed by a certain operation on the display 165 (e.g., the control panel) of the image forming apparatus 200.

As the calibration curve calculation starts, the powder amount detection unit 160 serving as a controller to perform the calibration curve calculation causes the display 165 to display an instruction to attach an empty waste toner bottle 91 to the waste toner bottle mount 90. After setting the empty waste toner bottle 91 in the waste toner bottle mount 90, an operator operates the display 165, for example, pushes a start button, thereby measuring capacitance. After measuring the capacitance of the empty waste toner bottle 91, the powder amount detection unit 160 causes the display 165 to display an instruction to attach a full waste toner bottle 91 to the waste toner bottle mount 90. After setting the full waste toner bottle 91 in the waste toner bottle mount 90, the operator operates the display 165, thereby measuring capacitance. After measuring the capacitance of the full waste toner bottle 91, the powder amount detection unit 160 acquires a calibration curve based on the capacitances of the empty and full waste toner bottles 91 and stores the calibration curve in the memory 163.

In the present embodiment, a temperature sensor 164 is provided to detect temperature around the waste toner bottle 91, and the amount of waste toner can be corrected based on the detection result obtained by the temperature sensor 164. This is because the distance between the flat plate electrodes 65 and 66 varies due to the thermal expansion of components to which the flat plate electrodes 65 and 66 are secured (i.e., the upper wall 90*a* or the lower wall 90*b*). As a result, the capacitance between the flat plate electrodes 65 and 66 varies. As an example, a correction factor $\alpha$ at high temperature and a correction factor $\beta$ at low temperature are stored in the memory 163. If temperature detected by the temperature sensor 164 is equal to or higher than a predetermined first threshold, the amount of waste toner is corrected by multiplying the calculated amount of waste toner by the correction factor $\alpha$ at high temperature. If the temperature detected by the temperature sensor 164 is equal to or less than a second threshold which is lower than the first threshold, the amount of waste toner is corrected by multiplying the calculated amount of waste toner by the correction factor $\beta$ at low temperature. As a result, the calculation error of the amount of waste toner due to an ambient temperature is minimized, thereby acquiring the amount of waste toner accurately. As described above, the calculated amount of waste toner is corrected according to temperature, but alternatively, the detected capacitance can be corrected according to temperature.

Further, the attachment of the waste toner bottle 91 can be detected based on the capacitance. The capacitance between the flat plate electrodes 65 and 66 is different when the waste toner bottle 91 is attached and when the waste toner bottle is absent. Therefore, if the capacitance is less than a reference value, the powder amount detection unit 160 detects that the waste toner bottle is not attached and displays an instruction prompting a user to attach the waste toner bottle 91 on the display 165. Accordingly, the number of components and the cost of the waste toner collection device 100 can be reduced as compared with a configuration in which an additional mechanism is provided for detecting the attachment of the waste toner bottle 91.

Figure 12:
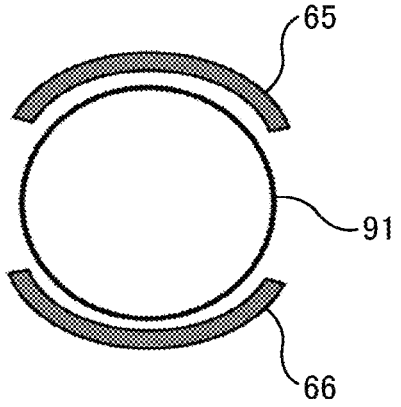
FIG. 12 is a schematic cross-sectional view of the waste toner bottle and a pair of arc-shaped electrodes.
Figure 13A:
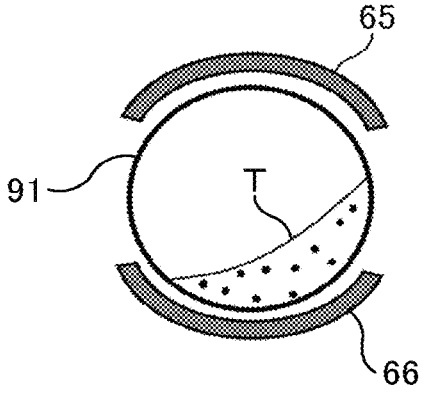
FIGS. 13A and 13B are schematic cross-sectional views of the waste toner bottle and the pair of arc-shaped electrodes.
Figure 13B:
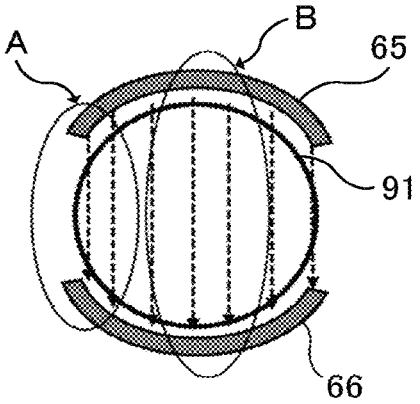

In the present embodiment, the pair of flat plate electrodes 65 and 66 is arranged in parallel. Alternatively, a pair of arc-shaped electrodes can be arranged along the outer circumference of the waste toner bottle 91 as illustrated in FIG. 12. However, the powder amount detector with the pair of flat plate electrodes 65 and 66 in parallel can accurately detect the amount of waste toner as compared with the pair of arc-shaped electrodes 65 and 66. FIGS. 13A and 13B are schematic cross-sectional views of the waste toner bottle 91 and the pair of arc-shaped electrodes 65 and 66.

Waste toner T in the waste toner bottle 91 forms various shapes in a cross-section perpendicular to the rotation axis of the waste toner bottle 91, for example, the waste toner T is unevenly distributed as illustrated in FIG. 13A, or the waste toner T is evenly distributed. In a case of the pair of electrodes 65 and 66 having the arc shape, as illustrated in FIG. 13B, a distance between ends of the pair of electrodes 65 and 66 is shorter than a distance between center portions of the pair of electrodes 65 and 66. As a result, a density of lines of electric force in area A near the ends of the pair of electrodes 65 and 66 is higher than a density of lines of electric force in area B near the center portions of the pair of electrodes 65 and 66. Accordingly, even if the height of waste toner is even in the horizontal direction in FIG. 13B, the capacitance is different between area A in which the density of lines of electric force is high and area B in which the density of lines of electric force is low. As a result, even if the amount of waste toner in the waste toner bottle 91 is the same, the capacitance when the waste toner T is unevenly distributed is different from the capacitance when the waste toner T is evenly distributed.

On the contrary, in the present embodiment, since the pair of electrodes 65 and 66 has a flat plate shape arranged in parallel, the lines of electric force between the pair of flat plate electrodes 65 and 66 are uniform. The capacitance when the waste toner T is unevenly distributed is not different from the capacitance when the waste toner T is evenly distributed. Therefore, the amount of toner can be accurately detected.

Figure 14:
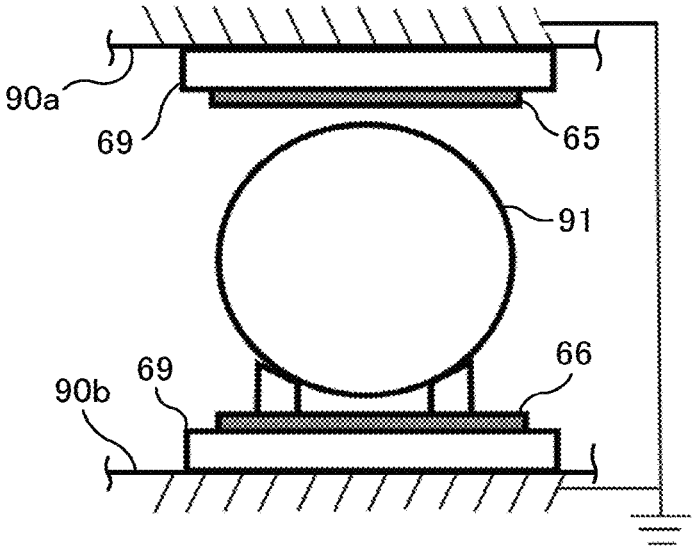
FIG. 14 is a schematic cross-sectional view of an example of the waste toner collection device provided with ground electrodes disposed outboard of flat plate electrodes in parallel.

FIG. 14 is a schematic cross-sectional view of an example of the waste toner collection device 100 provided with ground electrodes disposed outboard of the flat plate electrodes 65 and 66 in parallel. As illustrated in FIG. 14, the flat plate electrodes 65 and 66 are attached to the upper and lower walls 90*a* and 90*b* via insulators 69. Components constructing the upper and lower walls 90*a* and 90*b* are electrically grounded, thereby functioning as ground electrodes.

As illustrated in FIG. 1, the photoconductor drums 1, the charging devices, the intermediate transfer unit 30, and the like are disposed above the waste toner bottles 91. This configuration may cause the capacitance to vary. In the present embodiment, since the component constructing the upper wall 90*a* is electrically grounded as the ground electrode, electrical noises from the photoconductor drums 1, the charging devices, and the intermediate transfer unit 30 can be cut off.

Further, the sheets P set in the sheet tray 81*a* is disposed below the waste toner bottles 91, and the capacitance may vary depending on the material of the sheets P set in the sheet tray 81*a*. In the present embodiment, since the component constructing the lower wall 90*b* is electrically grounded as the ground electrode, electrical noises from below can be cut off.

Therefore, the variation of capacitance due to the electrical noises can be minimized, and the amount of waste toner can be accurately detected. Note that, preferably, the size of the ground electrodes (i.e., the upper and lower walls 90*a* and 90*b*) is greater than or equal to the size of the flat plate electrodes 65 and 66, and the ground electrodes cover the flat plate electrodes 65 and 66 as viewed from the ground electrodes (i.e., the upper and lower walls 90*a* and 90*b*).

Figure 15:
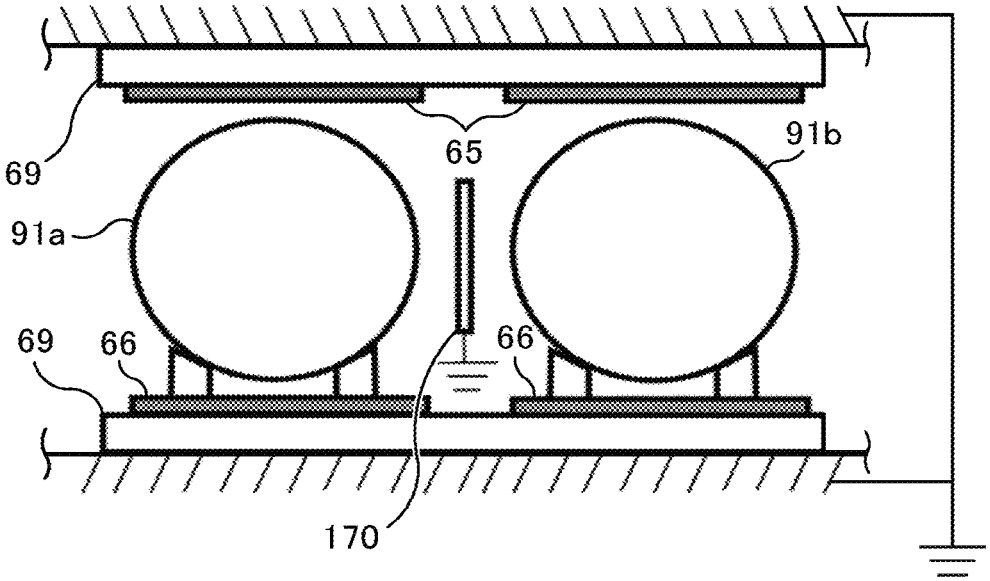
FIG. 15 is a schematic cross-sectional view of an example of the waste toner collection device provided with a ground electrode that partitions a first waste toner bottle and a second waste toner bottle.

FIG. 15 is a schematic cross-sectional view illustrating an example of the waste toner collection device 100 provided with a ground electrode 170 that partitions the first waste toner bottle 91*a* and the second waste toner bottle 91*b*. Without the ground electrodes 170 described above, some of the lines of electric force between the flat plate electrodes 65 and 66 (i.e., the lines of electric force near the adjacent waste toner bottle 91) may be changed due to the waste toner in the adjacent waste toner bottle 91. That is, current flows through the waste toner in the adjacent waste toner bottle 91. As a result, the capacitance may vary according to the amount of waste toner in the adjacent waste toner bottle 91, and the amount of toner may not be accurately detected.

However, as illustrated in FIG. 15, since the ground electrode 170 partitions the first waste toner bottle 91*a* and the second waste toner bottle 91*b*, the lines of electric force between the flat plate electrodes 65 and 66 are cut off by the ground electrode 170. That is, some of the lines of electric force between the flat plate electrodes 65 and 66 are directed toward the ground electrode 170 but do not go to the adjacent waste toner bottle 91 beyond the ground electrode 170. Therefore, this configuration can prevent the capacitance to be detected from being affected by the amount of waste toner in the adjacent waste toner bottle 91, and the amount of waste toner can be accurately detected.

Additional ground electrodes may be disposed on the left and right sides in FIG. 15 and the front and back sides in the direction perpendicular to the surface of the paper on which FIG. 15 is drawn so as to surround the respective waste toner bottles 91*a* and 91*b*. Therefore, the ground electrodes can cut off electrical noises caused by human passing by or another device disposed on the side, front, or back of the image forming apparatus 200, and the amount of waste toner can be more accurately detected.

In another embodiment, the flat plate electrodes 65 and 66 in parallel may be disposed on the left and right sides of the waste toner bottle 91 in the horizontal direction, which is perpendicular to the rotation axis of the waste toner bottle 91 and the vertical direction. However, preferably, the flat plate electrodes 65 and 66 in parallel are disposed below and above the waste toner bottle 91 in the vertical direction.

Figures 1, 16A:
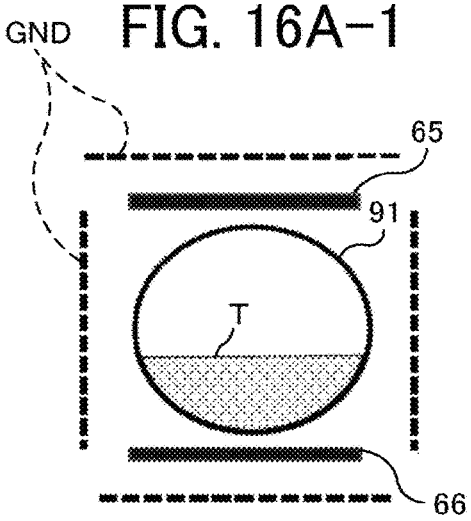
Figures 2, 16A:
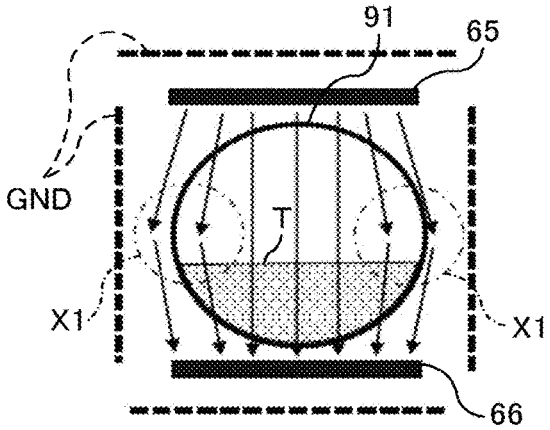
Figures 1, 16B:
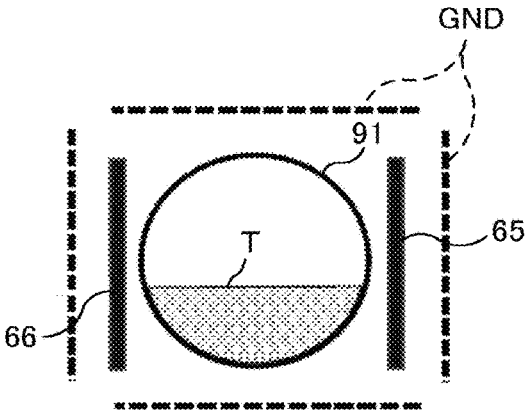
Figures 2, 16B:
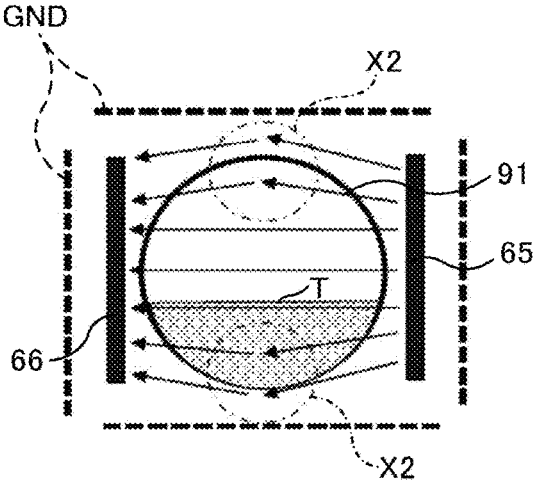

FIGS. 16A-1, 16A-2, 16B-1, and 16B-2 are schematic cross-sectional views illustrating the lines of electric force in the case in which the flat plate electrodes 65 and 66 in parallel are disposed below and above the waste toner bottle 91 in the vertical direction (i.e., FIGS. 16A-1 and 16A-2) and in the case in which the flat plate electrodes 65 and 66 in parallel are disposed on the left and right sides of the waste toner bottle 91 in the horizontal direction (i.e., FIGS. 16B-1 and 16B-2). GND indicated by broken lines in FIGS. 16A-1, 16A-2, 16B-1, and 16B-2 represents the ground electrode.

As illustrated in FIGS. 16A-2 and 16B-2, some of the lines of electric force are directed to the ground electrode (GND) near the ends of the flat plate electrodes 65 and 66 under the influence of the ground electrode. As a result, in areas X1 and X2 indicated by dash-dotted circles in FIGS. 16A-2 and 16B-2, the density of lines of electric force is low as compared with the other areas. Accordingly, sensitivity of detecting capacitance is lowered.

When the flat plate electrodes 65 and 66 are disposed below and above the waste toner bottle 91 in the vertical direction, the sensitivity is lowered in the areas X1 indicated by the dash-dotted circles in FIG. 16A-2 located near the middle of the waste toner bottle 91 in the vertical direction. On the other hand, when the flat plate electrodes 65 and 66 are disposed on the left and right sides of the waste toner bottle 91 in the horizontal direction, the sensitivity is lowered in the areas X2 indicated by the dash-dotted circles in FIG. 16B-2 located near the top portion and bottom portion of the waste toner bottle 91. Therefore, in the case in which the flat plate electrodes 65 and 66 are disposed on the left and right sides of the waste toner bottle 91 in the horizontal direction, the sensitivity is low when the waste toner bottle 91 is almost filled with waste toner.

In the present embodiment, the waste toner collection device 100 detects that the waste toner bottle 91 is almost filled with waste toner based on the capacitance, thereby prompting a user to replace of the waste toner bottle 91. Accordingly, in the case in which the flat plate electrodes 65 and 66 are disposed on the left and right sides of the waste toner bottle 91 in the horizontal direction, the waste toner bottle 91 filled with waste toner may be detected with the low sensitivity when the waste toner bottle 91 is almost filled with waste toner.

Therefore, a vertical arrangement in which the flat plate electrodes 65 and 66 are disposed below and above the waste toner bottle 91 in the vertical direction is more preferablet than a horizontal arrangement in which the flat plate electrodes 65 and 66 are disposed on the left and right sides of the waste toner bottle 91 in the horizontal direction, which is perpendicular to the rotation axis of the waste toner bottle 91 and the vertical direction. This is because the waste toner bottle 91 filled with waste toner can be detected with high accuracy.

Figure 17:
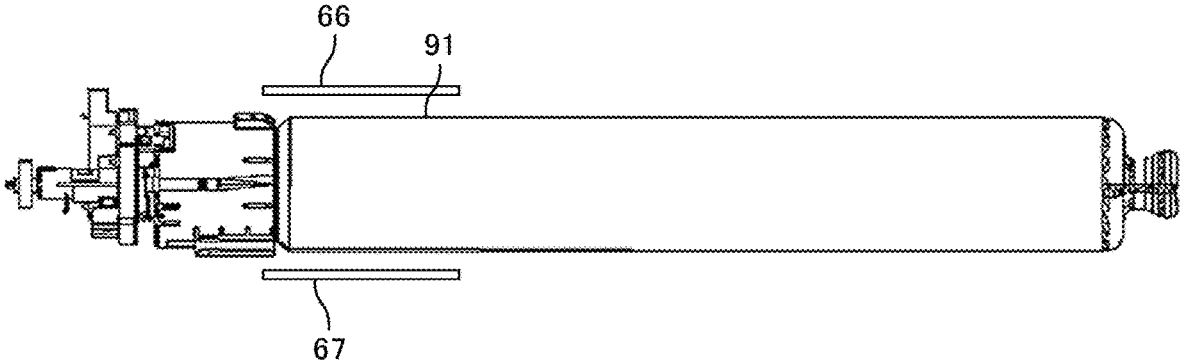
FIG. 17 is a schematic view illustrating an example of the pair of flat plate electrodes that is arranged only on the front end side of the waste toner bottle.

FIG. 17 is a schematic view illustrating an example of the pair of flat plate electrodes 67 and 66 that is arranged only on the front end side of the waste toner bottle 91. Waste toner is collected in the waste toner bottle 91 through a collection port disposed on the front end of the waste toner bottle 91. The helical rib 902*a* conveys the waste toner in the waste toner bottle 91 toward the rear end of the waste toner bottle 91 (to the right in FIG. 17). The amount of waste toner near the front end of the waste toner bottle 91 is small while the waste toner bottle 91 is not full, and increases when the waste toner bottle 91 is almost full. As a result, the capacitance varies greatly when the waste toner bottle 91 is almost full, thereby improving the sensitivity when the waste toner bottle 91 is almost full. Therefore, this configuration can accurately detect when the waste toner bottle 91 becomes full as compared with the configuration illustrated in FIG. 9A. On the other hand, the configuration illustrated in FIG. 9A can detect the total amount of waste toner in the waste toner bottle 91.

Figure 18:
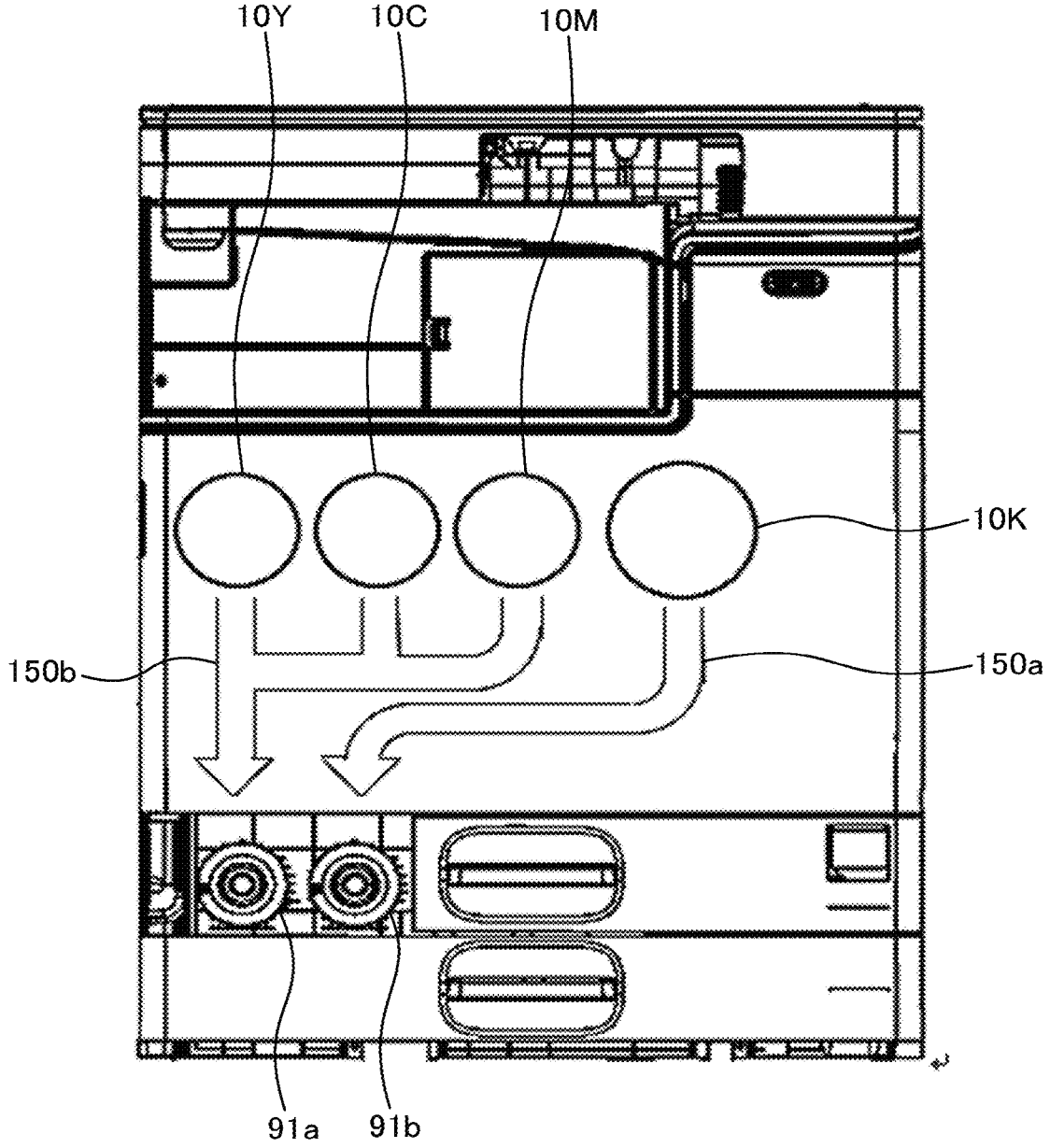
FIG. 18 is a schematic view illustrating an example of the waste toner collection device in which waste toner discharged from an image forming unit for black is collected in the second waste toner bottle, and waste toner discharged from image forming units for color is collected in the first waste toner bottle.

FIG. 18 is a schematic view illustrating another example of the waste toner collection device 100. Waste toner discharged from the image forming unit 10K for black is collected in the second waste toner bottle 91*b*, and waste toner discharged from the image forming units 10Y, 10M, and 10C for color is collected in the first waste toner bottle 91*a*.

In the example illustrated in FIG. 18, the switching unit 110 that switches the destination of the waste toner is not provided, and a waste toner conveyance unit 150*a* for black is directly coupled to the second waste toner carry-in section 600*b* and conveys waste toner discharged from the image forming unit 10K for black. On the other hand, a waste toner conveyance unit 150*b* for color is directly coupled to the first waste toner carry-in section 600*a* and conveys waste toner discharged from the image forming units 10Y,10C, and 10M for color. The waste toner discharged from the image forming unit 10K for black is collected in the second waste toner bottle 91*b* by the second waste toner carry-in section 600*b*, and the waste toner discharged from the image forming units 10Y, 10C, and 10M for color is collected in the first waste toner bottle 91*a* by the first waste toner carry-in section 600*a*. As illustrated in FIG. 18, the waste toner bottle to collect black waste toner (i.e., the waste toner bottle 91*b*) is different from the waste toner bottle to collect color (yellow, cyan, and magenta) waste toner (i.e., the waste toner bottle 91*a*), thereby facilitating the toner recycling.

In the present embodiment, two waste toner bottles 91*a* and 91*b* are provided, alternatively one waste toner bottle or three or more waste toner bottles may be provided. Further, as illustrated in FIG. 1, the toner bottle 17K for black is larger than the toner bottles 17Y, 17C and 17M for color, but in the present embodiment, both of the toner bottle 17K for black and the toner bottles 17Y, 17C and 17M for color are usable as a waste toner bottle in the waste toner collection device 100.

The embodiments described above are examples and can provide, for example, the following effects, respectively.

Aspect 1

A powder collection device such as the waste toner collection device 100 includes a collection container such as the waste toner bottle 91 to store powder collected and a powder amount detector including a pair of electrodes such as the pair of the electrodes 65 and 66. The powder amount detector detects an amount of powder in the collection container based on capacitance between the pair of electrodes.

In a comparative powder collection device, a collection container (e.g., waste toner bottle) is cantilevered, and a biasing member is disposed on the opposite side of the collection container opposite a support point at which the collection container is supported. The weight of the collection container causes the biasing member to contract, and an amount of powder is detected based on the displacement (amount of contraction) of the biasing member.

In the comparative powder collection device, even if the amount of powder in the collection container is the same, the displacement of the biasing member varies due to variation of vertical support position of the collection container caused by manufacturing or assembly tolerances. As a result, the amount of powder in the collection container may not be accurately detected.

In Aspect 1, the amount of powder in the collection container is detected based on the capacitance between the pair of electrodes. Since the dielectric constant of powder such as toner and the dielectric constant of air are different, the capacitance varies depending on the amount of powder in the collection container, and the amount of powder can be detected from the capacitance. As a result, even if the support position of the collection container varies due to the manufacturing or assembly tolerances, the ratio of powder to air between the pair of electrodes does not change. Therefore, the amount of powder in the collection container can be accurately detected without being affected by the variation of the support position of the collection container.

Aspect 2

In Aspect 1, the pair of electrodes is flat plate electrodes disposed outboard of the collection container and arranged in parallel across the collection container.

Accordingly, as described in the above embodiments, as compared with the arrangement in which the pair of electrodes is disposed inside the collection container, the amount of powder in the collection container can be accurately detected.

Aspect 3

In Aspect 1 or 2, each of the pair of electrodes 65 and 66 has the same size.

Accordingly, as described in the above embodiments, the powder amount detector can prevent a density of lines of electric force between the pair of electrodes 65 and 66 from varying. Therefore, uneven distribution of powder in the collection container such as the waste toner bottle 91 does not cause the capacitance to vary, and the amount of powder in the collection container can be accurately detected.

Aspect 4

In any one of Aspects 1 to 3, ground electrodes such as the ground electrodes (i.e., the upper and lower walls 90*a* and 90*b*) are disposed outboard of the pair of electrodes and grounded electrically.

Accordingly, as described in the above embodiments, the ground electrodes can cut off electrical noises outside the pair of electrodes, and the amount of powder in the collection container can be accurately detected.

Aspect 5

In Aspect 4, a size of the ground electrodes is greater than or equal to a size of the pair of electrodes.

Accordingly, as described in the above embodiments, the ground electrodes can satisfactorily cut off electrical noises outside the pair of electrodes.

Aspect 6

In the powder collection device according to any one of Aspects 1 to 5, a length of the pair of electrodes is greater than or equal to a half length of the collection container such as the waste toner bottle 91 in a longitudinal direction of the collection container.

Accordingly, as described in the above embodiments, the amount of powder in the collection container such as the waste toner bottle 91 can be accurately detected from when the amount of powder (e.g., the amount of waste toner) is small to when the amount of powder is large.

Aspect 7

In any one of Aspects 1 to 5, the pair of electrodes is arranged only on the front end side of the collection container such as the waste toner bottle 91 through which the powder is collected in the collection container.

Accordingly, as described with reference to FIG. 17, the sensitivity of detection can be improved when the collection container such as the waste toner bottle 91 is almost full, enabling to accurately detect when the collection container becomes full.

Aspect 8

The powder collection device according to any one of Aspects 1 to 7 further includes a memory such as the memory 163 to store a calibration curve indicating a relation between the capacitance between the pair of electrodes and the amount of powder in the collection container such as the waste toner bottle 91. The powder amount detector detects the amount of powder based on the calibration curve and the capacitance between the pair of electrodes. The powder amount detector measures the capacitance between the pair of electrodes when the collection container is empty and the capacitance between the pair of electrodes when the collection container is full to acquire the calibration curve (i.e., the calibration curve calculation).

Accordingly, as described in the above embodiments, the amount of powder in the collection container can be accurately detected based on the calibration curve corresponding to the distance between the pair of electrodes actually assembled.

Aspect 9

The powder collection device according to any one of Aspects 1 to 8 further includes a memory such as the memory 163 to store a calibration curve indicating a relation between the capacitance and the amount of powder in the collection container such as the waste toner bottle 91 and a temperature sensor such as the temperature sensor 164 to detect temperature. The powder amount detector detects the amount of powder based on the calibration curve, the capacitance between the pair of electrodes, and the temperature detected by the temperature sensor.

Accordingly, as described in the above-described embodiments, the amount of powder in the collection container can be acquired in consideration of the influence of temperature, such as capacitance variation due to thermal expansion and contraction of the components to which the pair of electrodes is secured. Accordingly, the amount of powder in the collection container can be accurately detected as compared with the case in which the powder amount detector detects the amount of powder based on the calibration curve and the capacitance between the pair of electrodes.

Aspect 10

The powder collection device according to any one of Aspects 1 to 9 further includes a conveyor such as the waste toner carry-in section 600 to convey the powder to the collection container and a rotation driver such as the bottle drive section 120 to rotate the collection container. A downstream portion of the conveyor in a direction in which the powder is conveyed is disposed inside the collection container, and the collection container has a cylindrical shape and includes a helical rib such as the helical rib 902*a* projecting inward from an inner circumference of the collection container.

Accordingly, as described in the above embodiments, the waste toner can be stably collected in the collection container such as the waste toner bottle 91, and a large amount of powder (waste toner) can be collected in the collection container.

Aspect 11

The powder collection device according to any one of Aspects 1 to 10 further comprising a plurality of collection containers including the collection container such as the waste toner bottle 91.

Accordingly, as described in the above embodiments, a large amount of powder such as waste toner can be collected in the collection container, and some usage of the powder collection device does not require the replacement of the collection container. Further, even if one of the plurality of collection containers becomes full, the powder can be collected in another collection container. As a result, the powder can be collected even before an empty collection container to be replaced is prepared. Furthermore, powder can be collected in the different collection container depending on the properties of the powder, so that the collected powder can be reused.

Aspect 12

In Aspect 11, at least one of the plurality of collection containers stores black waste toner serving as the powder, and others of the plurality of collection containers store color waste toner serving as the powder.

Accordingly, as described above with reference to FIG. 18, this configuration facilitates the reuse of toner.

Aspect 13

The powder collection device according to Aspect 11 further includes a switching unit such as the switching unit 110 to switch a destination of the powder among the plurality of collection containers so as to store the powder in the plurality of collection containers evenly.

Accordingly, as described in the above embodiments, this configuration can delay the time when the collection container becomes full, or some usage of the powder collection device does not require the replacement of the collection container.

Aspect 14

The powder collection device according to Aspect 11 further includes a switching unit such as the switching unit 110 to switch a destination of the powder when the powder amount detector detects that the collection containers of the destination is full.

Accordingly, as described in the above embodiments, even if one of the plurality of collection containers becomes full, the powder can be collected in another collection container. As a result, the powder can be collected even before an empty collection container to be replaced is prepared.

Aspect 15

The powder collection device according to any one of Aspects 11 to 14 further includes a ground electrode electrically grounded and disposed between the plurality of collection containers. The plurality of collection containers is arranged in parallel, and the powder amount detector is provided corresponding to each of the plurality of collection containers.

Accordingly, as described with reference to FIG. 15, the ground electrode such as the ground electrode 170 can cut off the influence of the powder in the adjacent collection container, thereby detecting the amount of powder in the collection container accurately.

Aspect 16

In any one of Aspects 1 to 15, the powder amount detector detects the attachment and detachment of the collection container based on the capacitance between the pair of the electrodes.

Accordingly, as described in the above embodiments, the number of components and the cost of the powder collection device can be reduced as compared with a configuration in which the device to detect the amount of powder in the collection container and the device to detect the attachment and detachment of the collection container are separately provided.

Aspect 17

An image forming apparatus includes the powder collection device according to any one of Aspects 1 to 16, such as the waste toner collection device 100 to collect waste toner serving as the powder.

Accordingly, the amount of waste toner in the collection container can be accurately detected.

Aspect 18

The image forming apparatus according to Aspect 17 further includes an image bearer to bear a latent image, a developing device to develop the latent image on the image bearer with a developer including at least toner, a storage container such as the toner bottle 17 to contain toner, and a toner supply device to supply the toner in the storage container to the developing device. The collection container and the storage container have the same shape.

Accordingly, the storage container such as the empty toner bottle 17 is reusable as the collection container such as the waste toner bottle 91.

As described above, according to the present disclosure, an amount of powder in a collection container can be accurately detected.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), DSP(digital signal processor), FPGA (field programmable gate array) and conventional circuit components arranged to perform the recited functions.

What is claimed is:

1. A powder collection device, comprising:

a collection container configured to store powder collected;

a powder amount detector, including a pair of electrodes disposed outside the collection container, configured to detect an amount of powder in the collection container based on capacitance between the pair of electrodes; and ground electrodes disposed outboard of, and attached to, the pair of electrodes and grounded electrically, wherein in a direction perpendicular to a longitudinal direction of the collection container, a length of each electrode is greater than a length of the collection container, wherein each of the pair of electrodes is a flat plate electrode and arranged in parallel across the collection container, wherein the ground electrodes directly cover an entirety of each of the pair of electrodes, wherein the collection container includes a plurality of collection containers, wherein the powder collection device further comprises a ground electrode electrically grounded and disposed between the plurality of collection containers, wherein the plurality of collection containers is arranged in parallel, and wherein the powder amount detector includes a plurality of powder amount detectors each provided corresponding to each of the plurality of collection containers.

2. The powder collection device according to claim 1, wherein each of the pair of electrodes has a same size.

3. The powder collection device according to claim 1, wherein a length of the pair of electrodes is greater than or equal to a half length of the collection container in the longitudinal direction of the collection container.

4. The powder collection device according to claim 1, wherein the pair of electrodes is arranged only on a front end side of the collection container through which the powder is collected in the collection container.

5. The powder collection device according to claim 1, wherein the powder amount detector further comprises:

a memory to store a calibration curve indicating a relation between the capacitance between the pair of electrodes and the amount of powder in the collection container; and circuitry configured to detect the amount of powder in the collection container based on the calibration curve and the capacitance between the pair of electrodes; and acquire the calibration curve based on the capacitance between the pair of electrodes when the collection container is empty and the capacitance between the pair of electrodes when the collection container is full.

6. The powder collection device according to claim 1, further comprising:

a conveyor configured to convey powder to the collection container, a downstream portion of the conveyor in a direction of conveyance of the powder disposed inside the collection container; and a rotation driver configured to rotate the collection container, wherein the collection container has a cylindrical shape and includes a helical rib projecting inward from an inner circumference of the collection container.

7. The powder collection device according to claim 1, wherein the powder amount detector is configured to detect attachment and detachment of the collection container based on the capacitance between the pair of electrodes.

8. An image forming apparatus comprising the powder collection device according to claim 1, configured to collect waste toner serving as the powder.

9. The image forming apparatus according to claim 8, further comprising:

an image bearer configured to bear a latent image;

a developing device configured to develop the latent image on the image bearer with a developer including at least toner;

a storage container configured to contain the toner; and a toner supply device configured to supply the toner in the storage container to the developing device, wherein the collection container and the storage container have a same shape.

10. A powder collection device, comprising:

a collection container configured to store powder collected; and a powder amount detector, including a pair of electrodes disposed outside the collection container, configured to detect an amount of powder in the collection container based on capacitance between the pair of electrodes, wherein in a direction perpendicular to a longitudinal direction of the collection container, a length of each electrode is greater than a length of the collection container, and wherein the powder amount detector further comprises:

a memory to store a calibration curve indicating a relation between the capacitance and the amount of powder in the collection container;

a temperature sensor configured to detect temperature; and circuitry configured to detect the amount of powder based on the calibration curve, the capacitance between the pair of electrodes, and the temperature detected by the temperature sensor, wherein the collection container includes a plurality of collection containers, wherein the powder collection device further comprises a ground electrode electrically grounded and disposed between the plurality of collection containers, wherein the plurality of collection containers is arranged in parallel, and wherein the powder amount detector includes a plurality of powder amount detectors each provided corresponding to each of the plurality of collection containers.

11. The powder collection device according to claim 10, wherein at least one of the plurality of collection containers is configured to store black waste toner serving as the powder, and others of the plurality of collection containers are configured to store color waste toner serving as the powder.

12. The powder collection device according to claim 10, further comprising a switch configured to switch a destination of the powder among the plurality of collection containers to store the powder in the plurality of collection containers evenly.

13. The powder collection device according to claim 10, further comprising a switch configured to switch a destination of the powder among the plurality of collection containers when the powder amount detector detects that the collection container of the destination is full.

* * * * *